United States Patent [19]

Kumagai

[11] Patent Number: 4,801,096

[45] Date of Patent: Jan. 31, 1989

[54] AUTOMATIC GUNNING APPARATUS WITH DETACHABLY MOUNTED GUNNING PIPE

[75] Inventor: Yukio Kumagai, Zama, Japan

[73] Assignee: Pfizer Inc., New York, N.Y.

[21] Appl. No.: 32,812

[22] Filed: Apr. 1, 1987

[51] Int. Cl.[4] ..... B05B 3/18

[52] U.S. Cl. ..... 239/752; 239/280.5; 239/288

[58] Field of Search ..... 239/227, 750, 752, 753, 239/273, 280, 280.5, 281, 288, DIG. 13; 266/281; 264/30

[56] References Cited

U.S. PATENT DOCUMENTS

| | | | |
|---|---|---|---|
| 3,662,709 | 5/1972 | Janco | 239/227 |
| 3,827,633 | 8/1974 | Kouno et al. | 239/132.3 |
| 3,917,170 | 11/1975 | Marino | 239/132.3 |
| 3,957,203 | 5/1976 | Bullard | 239/753 |
| 4,106,760 | 8/1978 | Kono et al. | 266/281 |
| 4,127,626 | 11/1978 | Kubo et al. | 264/30 |
| 4,201,342 | 5/1980 | Stram | 239/752 |
| 4,222,522 | 9/1980 | Kubo et al. | 239/227 |
| 4,302,179 | 11/1981 | Pont | 239/280.5 |
| 4,690,328 | 9/1987 | Roehl | 239/227 |

FOREIGN PATENT DOCUMENTS

| | | |
|---|---|---|
| 486268 | 12/1976 | Australia . |
| 493704 | 1/1977 | Australia . |
| 497355 | 10/1978 | Australia . |
| 2531986 | 2/1976 | Fed. Rep. of Germany . |

*Primary Examiner*—Andres Kashnikow
*Assistant Examiner*—Michael J. Forman
*Attorney, Agent, or Firm*—Peter C. Richardson; Lawrence C. Akers

[57] ABSTRACT

An automatic gunning apparatus for repairing metallurgical furnaces includes a device for supplying refractory material to effect the repair; a detachably mounted gunning pipe fitted to the supply device; a pair of pinch rollers for moving the gunning pipe forward along its axis; a rotating drum through which the gunning pipe passes and which encloses the gunning pipe; a plurality of rollers for rotating the drum about its axis; a platform supporting the rollers; a column bearing the platform; a device for tilting the platform; and a support fixture for the pinch rollers rigidly connected to the drum such that the gunning pipe is axially rotated by the rotation of the drum.

19 Claims, 2 Drawing Sheets

AUTOMATIC GUNNING APPARATUS WITH DETACHABLY MOUNTED GUNNING PIPE

BACKGROUND OF THE INVENTION

This invention concerns an automatic gunning apparatus for the repair of metallurgical furnaces which has a detachably mounted gunning pipe. More specifically, it concerns an automatic gunning apparatus for repairing the refractory lining of metallurgical furnaces such as converters and electric furnaces, the whole apparatus being compact and so designed that the gunning pipe can be freely attached and detached.

Conventionally, the repair by gunning pipe of the amorphous refractory lining of converters and electric furnaces used for steelmaking has been carried out by the following methods:

(1) Insertion of a gunning pipe into the furnace by a skilled operator who carries out the gunning operation manually, or (2) Operation by remote control of an automatic gunning apparatus equipped with a gunning pipe which is water cooled and which has a mechanism for elongating and contracting the pipe.

In method (1), i.e., manual repair, the operator must carry the heavy gunning pipe for a long period of time in order to insert it into the furnace at high temperature and perform the gunning operation under high temperature conditions, which requires great muscular effort.

In method (2), the apparatus is usually mounted on a self-propelled vehicle, the gunning pipe being water cooled and having a mechanism by which it can be elongated or contracted, so that the gunning operation can be performed by remote control. In this case, however, the apparatus is bulky, while the mechanism is complex and costly. In particular, although the gunning pipe has a mechanism by which it may be elongated or contracted, its overall length when contracted is still considerable, so its manipulation, operation and control in a narrow space is complicated and requires experience. Further, a large space is required to store the apparatus when it is on standby for operation. In addition, although the gunning pipe is enclosed in a water-cooled tube, it deforms due to wear and heat and often has to be replaced. The replacement operation, moreover, is tedious and requires a great deal of preparation.

The present invention therefore aims to solve these problems inherent in the prior art. More specifically, it aims to provide an automatic gunning apparatus of simple structure for repairing metallurgical furnaces which has a detachably mounted gunning pipe and which can accommodate a gunning pipe of simple structure such as the gunning pipe generally used for manual repair operations in the past.

A further object of the present invention is to provide an automatic gunning apparatus for repairing metallurgical furnaces which has a detachably mounted gunning pipe, wherein the gunning pipe can be freely mounted and detached, the pipe being mounted on the apparatus at the beginning of the gunning operation, the operation being carried out by remote control, and the pipe detached from the apparatus when the operation has been completed.

SUMMARY OF THE INVENTION

The automatic gunning apparatus for repairing metallurgical furnaces described in the present invention comprises means for supplying refractory material to effect the repair; a detachably mounted gunning pipe fitted to the supply means; a pair of pinch rollers for moving the gunning pipe forward along its axis; a rotating drum through which the gunning pipe passes and which encloses the gunning pipe; means for rotating the drum about its axis; a platform supporting the drum rotating means; a column bearing the platform; means for tilting the platform; and a support fixture for the pinch rollers rigidly connected to the drum such that the gunning pipe is axially rotated by the rotation of the drum.

In preferred forms of the present invention, the column includes means for rotating the column about its axis; the pair of pinch rollers which move the gunning pipe forward in the axial direction are arranged such that they have an axis perpendicular to the axis of the gunning pipe; either one or both of the pinch rollers is easily removed or released by a spring mechanism; the drum rotating means includes a plurality of drive rollers which are in close contact with the drum such that their axes are parallel to the axis of the drum; and a portion of the circumference of the drum can be opened to insert the gunning pipe in the drum. Any of the platform, column and support fixture, alone or in combination, may be provided with a shield for protecting the apparatus from heat or flame such that the shield is either integral with or mutually engageable with its supporting unit of the apparatus.

The gunning pipe of the present automatic repair apparatus may be that which is usually used for manual repair of furnaces, while the repair apparatus may be transported by forklift, mounted on a moving pallet, self-propelled, or of a type which can be suspended from a crane.

BRIEF DESCRIPTION OF THE DRAWINGS

The above and other objects, features and advantages of the automatic gunning apparatus of the present invention will become evident from the following detailed description of embodiments thereof in conjuction with the accompanying drawings wherein like reference numerals indicate like structure throughout the several views.

DETAILED DESCRIPTION OF THE INVENTION

Figure 2:
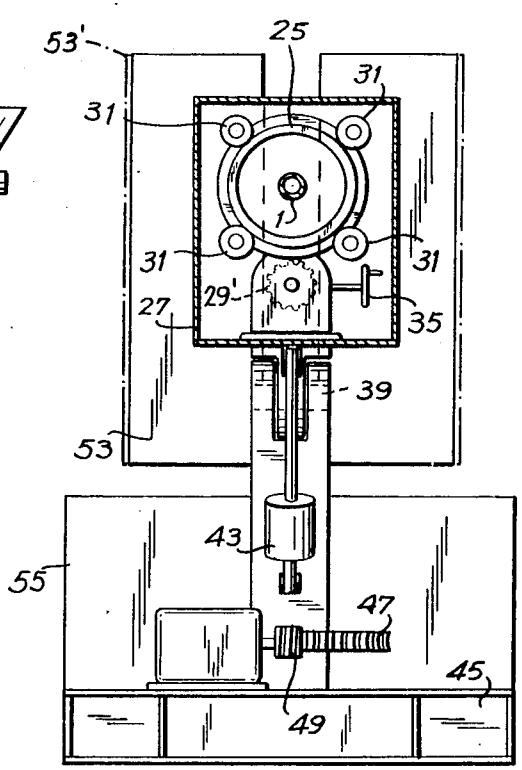
FIG. 1 and FIG. 2 are, respectively, a side elevational view and a rear elevational view, shown in partial cross section, of a preferred embodiment of the automatic gunning apparatus with detachably mounted gunning pipe of the present invention.

The gunning apparatus is shown with a gunning pipe 1 installed. As shown in FIGS. 1-4, gunning pipe 1 is connected to a mixer 5 by means of a swivel joint 3. A material feed hose 7 and a water feed hose 9 are connected to mixer 5, in which water and the refractory material for effecting the repair are mixed. The water supply to mixer 5 is controlled by a valve 11.

Figure 1:
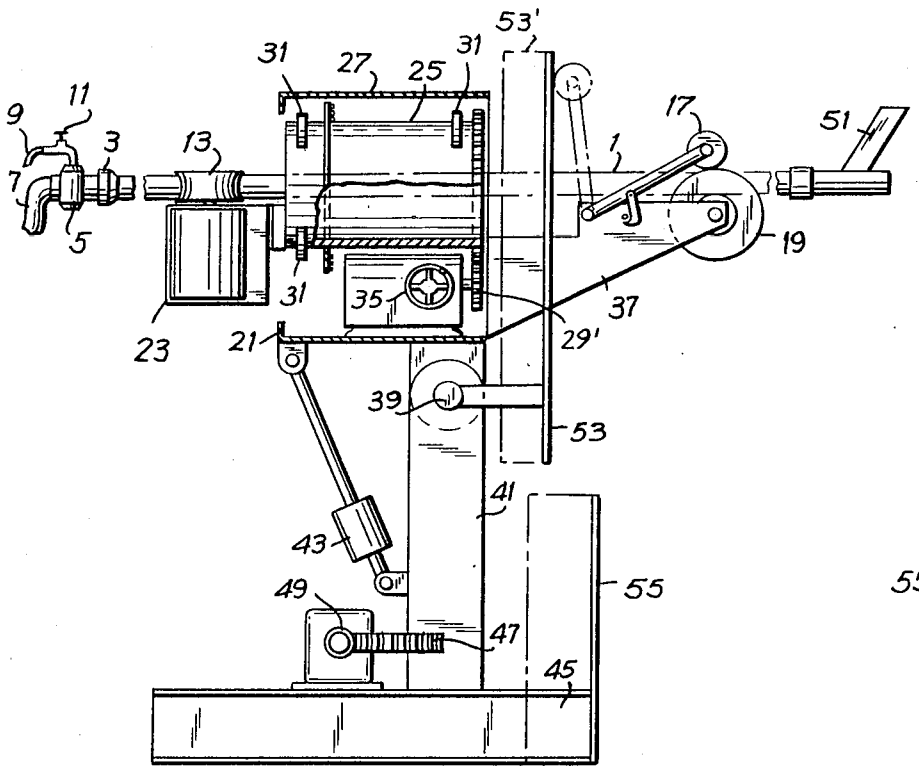

The gunning apparatus of the embodiment shown in FIGS. 1 and 2 has a support platform 21, equipped with a pair of pinch rollers 13 and a pair of receiving rollers 17 and 19. More specifically, pinch rollers 13 have an axis perpendicular to the axis of gunning pipe 1 and consist of either two drive rollers or one drive roller and one idle roller. Preferably, in the latter case, the idle roller can be freely attached and detached together with gunning pipe 1, and can also be easily removed when mounting or detaching the pipe.

Receiving rollers 17, 19 are installed to the front of platform 21. The upper roller 17 can be spring released to the position shown by the dotted line in FIG. 1 so that when fitting gunning pipe 1 with gunning nozzle 51, or removing it from the apparatus, gunning pipe 1 can be passed through drum 25 and positioned on fixed roller 19.

A cover 27 is fitted to platform 21 and houses drum 25. As shown in FIG. 2, drum 25 is supported by four pressure rollers 31, and is rotated by an axial drive gear 29'. Gear 29' is driven clockwise or counterclockwise, as required by the gunning operation, by a motor (not shown in the drawing). A handle 35 controls the rotating speed of drum 25.

As shown in FIG. 1, an arm 37 extends forward from platform 21, fixed receiving roller 19 being held at the tip of arm 37. As described above, spring-loaded receiving roller 17 is positioned above fixed receiving roller 19 and rotates in unison with fixed receiving roller 19 so as to grip gunning pipe 1.

Platform 21 is supported by a column 41 through pin 39, and is also supported by one end of electric cylinder 43 which is joined at its other end to column 41. Platform 21, therefore, tilts about pin 39 in accordance with the elongation and contraction of cylinder 43.

Column 41 is mounted on boom platform 45 such that it can rotate, being provided with a worm gear 47. Worm gear 47 engages with worm 49, and when worm 49 turns, column 41 rotates.

Each of arm 37, column 41 and boom platform 45 can include a shield 53, 55, either integrally attached to the apparatus or engagable with its supporting means when needed during a gunning operation. As shown in FIGS. 1 and 2, shield 53, positioned so as to protect cover 27 and column 41, is attached to the apparatus through pin 39, includes side folds 53', and has an opening through which gunning pipe 1 can pass.

The action of the automatic gunning apparatus of the present invention described above is as follows:

Firstly, either one or both of pinch rollers 13, and receiving roller 17, are spring released, following which gunning pipe 1 is passed through drum 25 from its rear end and positioned on receiving roller 19. Gunning pipe 1 is then gripped by pinch rollers 13 and receiving roller 17 is moved down, so that the pipe is finally held by pinch rollers 13 on either side and by receiving roller 19, respectively.

Gunning pipe 1 is moved in the direction of its axis by the rotation of pinch rollers 13. Gunning pipe 1 can also be rotated about its own axis by driving the rotating gear 29'. When gear 29' is rotated, drum 25 rotates, and a plate 23 which supports pinch rollers 13 and is fixed to drum 25 rotates together with the drum. Gunning pipe 1, which is held by pinch rollers 13, therefore rotates, and so does gunning nozzle 51 which is attached to the end of gunning pipe 1.

Gunning pipe 1 can also be tilted about pin 39. This can be done by elongating or contracting electric cylinder 43 so as to tilt platform 21.

In addition, gunning pipe 1 can be rotated about column 41 by means of worm gear mechanism 47, 49. When worm 49 is rotated, column 41, which is equipped with a worm gear 47 that engages with worm 49, rotates on its own axis; thus gunning pipe 1 also rotates about this axis. Further, when gunning pipe 1 is rotated about column 41, shield 53 functionally attached to the pipe also rotates. On the other hand, shield 55 protecting platform 45 remains steady.

It is of course to be understood that pinch rollers 13, drive gear 29', electric cylinder 43 and worm 49 can be operated by remote control.

Figure 4:
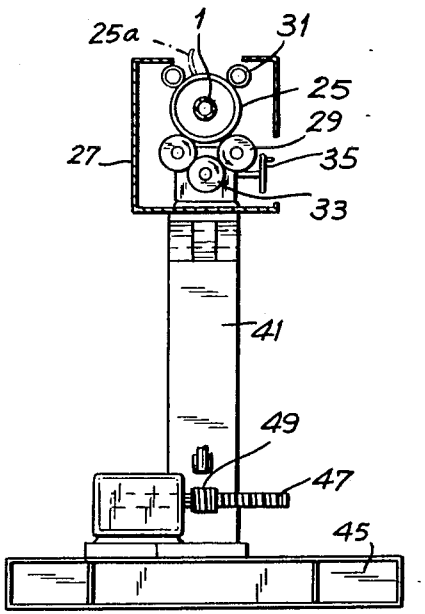
FIG. 3 and FIG. 4 are, respectively, a side elevational view and a rear elevational view, shown in partial cross section, of a second preferred embodiment of the present automatic gunning apparatus.
Figure 3:
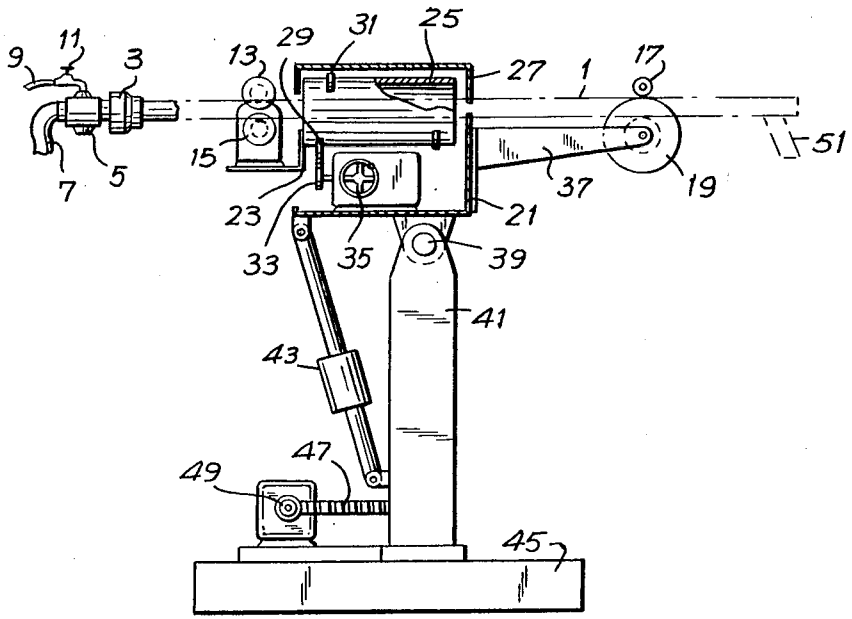

A second preferred embodiment of the automatic gunning apparatus of the present invention is shown in FIGS. 3 and 4. While this gunning apparatus operates basically the same as the apparatus of FIGS. 1 and 2, there are slight differences in the apparatus and its operation which are described below.

The gunning apparatus of FIGS. 3 and 4 has a support platform 21 equipped with a pair of pinch rollers 13 and 15 and a pair of receiving rollers 17 and 19. The upper rollers 13 and 17 are of the spring-loaded type, and spring out when mounting or detaching gunning pipe 1. Roller 15 on the lower, fixed side is motor driven and is mounted on supporting plate 23. Plate 23 is fixed to drum 25 and rotates together with it.

On platform 21, an upper release cover 27 is mounted which houses drum 25. As shown in FIG. 4, drum 25 is supported by two axial rotation drive rollers 29, and is rotated while being held by pressure rollers 31 which move in unison with drive rollers 29. Drive rollers 29 are themselves rotated by means of a gear 33 driven by a motor not shown in the drawing. Further, a portion **25*a* of the circumference of drum 25 can be opened by a spring release to insert gunning pipe 1 in the drum, after which drum 25** may be closed to reform a smooth cylindrical drum surface.

Column 41 is mounted vertically on boom platform 45 such that it can rotate, and is provided with a worm gear 47. Worm gear 47 engages with worm 49, and when worm 49 turns, column 41 rotates.

To insert gunning pipe 1 in this apparatus, the upper pinch roller 13, the spring plate **25*a* of drum 25 and receiving roller 17 are first released. With the apparatus so arranged, gunning pipe 1 is inserted into drum 25 through the open space left by spring plate 25*a*, then positioned on pinch roller 15 and receiving roller 19. Following this, upper pinch roller 13 and receiving roller 17 are moved down so that gunning pipe 1 is gripped by lower pinch roller 15 and receiving roller 19, and spring plate 25*a* of drum 25** is closed.

To detach gunning pipe 1, spring plate **25*a* of drum 25 is released, upper pinch roller 13 and receiving roller 17 are released and, after opening up the whole apparatus above gunning pipe 1, the latter is removed from the open part of drum 25**.

Gunning pipe 1 is moved in the direction of its axis by the rotation of pinch roller 15. Pinch roller 15 moves in unison with upper roller 13 so as to grip gunning pipe 1, and when pinch roller 15 is rotated, gunning pipe 1 moves forward or backward according to the direction of rotation. Gunning pipe 1 can be rotated about its own axis by driving the axial rotation drive roller 29. When drive roller 29 is rotated, rotating drum 25 rotates. Plate 23, which supports pinch rollers 13 and 15, is fixed to drum 25 and rotates with it. Gunning pipe 1, which is gripped by pinch rollers 13 and 15, therefore rotates, and so does gunning nozzle 51 at the end of gunning pipe 1.

Gunning pipe 1 can also be tilted about pin 39. This can be done by elongating or contracting electric cylinder 43 so as to tilt platform 21.

In addition, gunning pipe 1 can be rotated about column 41 by means of the worm gear mechanism 47, 49. When worm 49 is rotated, column 41, which is equipped with a worm gear 47 that engages with worm 49, rotates on its own axis; thus gunning pipe 1 also rotates about this axis.

It is of course to be understood that fixed pinch roller 15, drive roller 29, electric cylinder 43 and worm 49 can be operated by remote control.

As can be seen from the above description of the automatic gunning apparatus of the present invention, the gunning pipe used for applying refractory material can be freely mounted on or detached from the apparatus, while the apparatus itself has a simple structure which permits movement of the gunning pipe along the axis of the pipe, rotation about the axis of the pipe, tilting, and rotation about a support axis. In particular, the apparatus can accommodate gunning pipes which have normally been used for manual repair operations in the past, and requires no extra equipment outlay.

The automatic gunning apparatus of the present invention, moreover, is compact. It can be transported by forklift, mounted on a moving pallet or on a platform with wheels as a self-propelled moving vehicle, or suspended from the roof by a crane.

Finally, the automatic gunning apparatus of the present invention can be used for repairing converters, electric furnaces and smelting furnaces, or for repairing the refractory lining of various types of tundishes and refining pans.

I claim:

1. An automatic gunning apparatus for repairing the refractory lining of a furnace, comprising in combination:

means for supplying refractory material to effect the repair;

a moveably and detachably mounted gunning pipe having a circular cross sectional area for conveying the refractory material from the refractory material supply means to the interior of the furnace, the gunning pipe being connected at a proximal end thereof to the refractory material supply means, and having a gunning nozzle attached to the distal end thereof;

a pair of pinch rollers arranged about the gunning pipe near its proximal end, such that the longitudinal central axes of the pinch rollers are perpendicular to the longitudinal central axis of the gunning pipe, with the pinch rollers cooperating with the gunning pipe is such manner as to alternatively enable the gunning pipe to be held in position near its proximal end and to be secureably slideable between the pinch rollers in a direction along the longitudinal central axis of the gunning pipe, in response to a force applied to the gunning pipe;

a rotatable drum through which a central section of the gunning pipe passes and which encloses the gunning pipe, with the rotatable drum and gunning pipe having a common longitudinal central axis;

means for attaching the pinch rollers to the rotatable drum such that the pinch rollers, drum and gunning pile held by the pinch rollers and drum are simultaneously jointly co-rotatable;

means for rotating the drum about its longitudinal central axis;

a pair of receiving rollers arranged about the gunning pipe near its distal end, such that the longitudinal central axes of the receiving rollers are perpendicular to the longitudinal central axis of the gunning pipe, with the receiving rollers cooperating with the gunning pipe in such manner as to alternatively enable the running pipe to be held in position near its distal end and to be secureably slideable between the receiving rollers in a direction along the longitudinal central axis of the gunning pipe in response to a force applied to the gunning pipe;

a platform supporting the rotatable drum and drum rotating means;

means for attaching the receiving rollers to the platform;

a vertical column pivotally bearing the platform at an upper end of the column;

means for tilting the platform upward and downward about a pivoting pin connecting the platform to the column, to a position determined by an angle measured between the vertical longitudinal central axis of the column and the plane of the platform, such that the direction of the common longitudinal central axis of the rotatable drum and gunning pipe remains rotationally unchanged about the vertical longitudinal central axis of the column;

a horizontal base supporting the column; and means for rotating the column on the base;

the gunning pipe being detachable from the apparatus by the provision that at least one of the pinch and receiving rollers includes a spring release mechanism enabling it to be retracted away from its normal operating position in proximity with the gunning pipe at selected times; and by the provision that a portion of the circumferene of the rotatable drum be removable at selected times from its normal operating position enclosing a central section of the gunning pipe; thereby alternatively enabling the gunning pipe to be emplaced or removed through the gap in the rotatable drum formed by removal of the circumferential portion thereof and the space afforded by retraction of at least one of the pinch and receiving rollers.

2. The apparatus of claim 1 wherein installation and removal of the detachable gunning pipe is facilitated by the provision that one each of the pinch and receiving rollers includes a spring release mechanism enabling it to be retracted away from its normal operating position in proximity with the gunning pipe, at such selected times as when the gunning pipe is being installed or removed.

3. The apparatus of claim 1 wherein the means for supplying refractory material is a mixer to which refractory material and water are fed through separate lines, becoming mixed in said mixer; said mixer being connected to the proximal end of the gunning pipe by a swivel joint.

4. The apparatus of claim 1 wherein the gunning nozzle is attached to the distal end of the gunning pipe such that an outlet end of the nozzle is oriented at an angle with respect to the longitudinal central axis of the gunning pipe.

5. The apparatus of claim 1 wherein the means for attaching the pinch rollers to the drum comprises a plate having one end which supports the pinch rollers and an opposite end which is fixedly attached to the rotatable drum.

6. The apparatus of claim 1 wherein the means for rotating the drum comprises a plurality of drive rollers which are in proximate contact with the drum such that their longitudinal central axes are parallel to the longitudinal central axis of the drum.

7. The apparatus of claim 1 wherein the means for attaching the receiving rollers to the platform comprises a pair of arms extending from a front end of the platform along parallel axes with the longitudinal central axis of the gunning pipe, with one arm being attached to the front end of the platform on each side of the gunning pipe, and with the receiving rollers being attached to the arms such that the receiving roller are perpendicular to the longitudinal central axis of the gunning pipe, with one receiving roller supporting the gunning pipe from below and the other receiving roller proximately contacting the gunning pipe from above.

8. The apparatus of claim 1 wherein the means for tilting the platform comprises a piston and cylinder arm attached at one end thereof to the column and at the opposite end thereof to the platform.

9. The apparatus of claim 8 wherein the piston and cylinder arm operates one of pneumatically and hydraulically.

10. The apparatus of claim 9 wherein the piston and cylinder arm is electrically driven.

11. The apparatus of claim 1 wherein the means for rotating the drum comprises a drive gear coaxially mounted with the longitudinal central axis of the drum.

12. The apparatus of claim 11 wherein the shield means comprises at least one of a shield perpendicularly attached to the gunning pipe and rotatable therewith; and a shield fixedly attached to the platform.

13. The apparatus of claim 1 wherein the means for rotating the column on the base comprises a worm gear which engagingly cooperates with a worm.

14. The apparatus of claim 1 further comprised by thermal shield means.

15. The apparatus of claim 1 which is mounted on a self-propelled vehicle.

16. The apparatus of claim 1 which is remotely controllable.

17. The apparatus of claim 1 wherein both of the pinch rollers are drive rollers.

18. The apparatus of claim 1 wherein one of the pinch rollers is a drive roller and the other one is an idle roller.

19. The apparatus of claim 18 wherein the idle roller includes a spring release mechanism.

* * * * *